US005746582A

United States Patent [19]

Patterson

[11] Patent Number: 5,746,582

[45] Date of Patent: May 5, 1998

[54] THROUGH-TUBING, RETRIEVABLE DOWNHOLE SUBMERSIBLE ELECTRICAL PUMP AND METHOD OF USING SAME

[75] Inventor: John C. Patterson, Garland, Tex.

[73] Assignee: Atlantic Richfield Company, Los Angeles, Calif.

[21] Appl. No.: 717,985

[22] Filed: Sep. 23, 1996

[51] Int. Cl.[6] ..... F04B 17/03

[52] U.S. Cl. ..... 417/53; 417/360; 418/48; 166/377

[58] Field of Search ..... 166/105, 377, 166/187; 417/360, 423.3, 424.1, 424.2, 410.3, 422, 53; 310/87; 418/48

[56] References Cited

U.S. PATENT DOCUMENTS

| | | | |
|---|---|---|---|
| 2,674,194 | 4/1954 | Arutunoff | 417/360 |
| 3,041,977 | 7/1962 | Boyd | 417/360 |
| 3,347,169 | 10/1967 | Cronin, Jr. et al. | 418/48 |
| 3,556,215 | 1/1971 | Owens | 166/187 |
| 3,853,430 | 12/1974 | O'Rourke | 417/360 |
| 4,171,934 | 10/1979 | Zehren | 417/360 |
| 4,541,782 | 9/1985 | Mohn | 417/422 |
| 4,749,341 | 6/1988 | Bayh, III | 417/360 |
| 5,070,940 | 12/1991 | Conner et al. | 166/105 |
| 5,131,466 | 7/1992 | Chacin et al. | 166/105 |
| 5,297,943 | 3/1994 | Martin | 417/422 |
| 5,367,214 | 11/1994 | Turner, Jr. | 310/87 |
| 5,501,580 | 3/1996 | Barrus et al. | 417/360 |
| 5,577,560 | 11/1996 | Coronado et al. | 166/387 |

OTHER PUBLICATIONS

Petroleum Production Engineering–Oil Field Exploitation: L.C. Uren, 1953, McGraw–Hill Book Co., pp. 390–391.

Brochure: ESPCP™, Centrilift, A Baker Hughes Co., Claremore OK.

Brochure: Rotalift™, Highland Corp, Odessa, TX.

Brochures:(1) Automatic Top Seal and (2) Processing–cavity pumps; National–Oilwell, Houston, TX.

*Primary Examiner*—Timothy Thorpe
*Assistant Examiner*—Peter G. Korytnyk
*Attorney, Agent, or Firm*—Drude Faulconer

[57] ABSTRACT

A method and a pumping system for lifting formation fluids from a production zone in a wellbore which allows the pump unit to be retrieved through the production tubing while leaving the tubing, electrical cable, and the remainder of the components of the pumping system in place. A pump unit is retrievably positioned within the production tubing and is releasably connected to a downhole motor whereby the motor will drive the pump when electricity is supplied thereto through the cable secured to the tubing. This allows the pump unit to be both retrieved and installed through the tubing without removing the production tubing string, the motor, or the electrical cable from the wellbore.

13 Claims, 2 Drawing Sheets

THROUGH-TUBING, RETRIEVABLE DOWNHOLE SUBMERSIBLE ELECTRICAL PUMP AND METHOD OF USING SAME

DESCRIPTION

1. Technical Field

The present invention relates to a method and system for lifting fluids through a well and in one of its aspects relates to a method and pumping system wherein a downhole, electrically-driven pump can be installed and retrieved through the production tubing without removing the tubing and associated electrical cable.

2. Background Art

It has long been known to use submersible, electrical-driven, downhole pumping systems in a well to lift subterranean formation fluids to the surface. Typically, these systems include a submersible electric motor; a "protection" section; and a pump unit, all connected together with the motor at the bottom. The entire assembly is suspended in the wellbore on a string of production tubing through which the fluids are pumped to the surface. Electricity is transmitted from the surface to the downhole electric motor through a three-conductor armored cable which, in turn, is clamped at spaced intervals along the outside of the production tubing.

In earlier systems, the pump unit, itself, was usually comprised of a multistage, centrifugal pump having a plurality of propellers arranged in series. For a good description of such a pump system, see PETROLEUM PRODUCTION ENGINEERING, Oil Field Exploitation, L. C. Uren, 3rd Ed., McGraw-Hill Book Co., 1953, pps.390–391. Centrifugal pumps, while efficient in lifting substantially light and clean fluids (e.g. oil an water), they become relatively ineffective when lifting more viscous and dirty fluids (e.g. heavy oil laden with sand).

Recently, progressive cavity (PC) pumps have been developed which when coupled with conventional downhole submersible, electric motors substantially improve the ability of the pumping system in lifting heavy viscous, sandy fluids. In these systems, a flexible shaft or wobble joint assembly is interposed between the motor and the PC pump unit which converts the concentric rotation of the electric motor into the eccentric motion required by the rotor in the PC pump. An example of a known pump system of this type is the Electric Submersible Progressive Cavity Pump ("ESPCP"™); available from Centrilift, A Baker Hughes Co., Claremore, Okla.

Although, this type PC pumping system improves the efficiency in lifting dirty oil and the like, the average time between start-up and failure can still be unacceptably short due to the extreme wear on the pump, itself. Since these prior art pumping system are installed as an integral unit of and is suspended from the production tubing, the entire string of tubing and associated electrical cable as well as the entire pumping system have to be pulled from the well in order to repair or replace a worn or damaged pump. This is true even though most of the components of the pumping system, i.e. the downhole motor, gear box, and protector of the pumping system, are usually okay and do not need maintenance each time the pump unit fails.

As will be understood by anyone working with such pumping systems, it is expensive to pull and then re-run the tubing and the associated electrical cable each time the pump unit needs to be serviced or replaced. Accordingly, the economic advantages of being able to retrieve, service, and replace only the pump unit, itself, while leaving the rest of the pumping system in place will be instantly recognized by those skilled in this art.

SUMMARY OF THE INVENTION

The present invention provides a method and a pumping system for lifting formation fluids from a production zone in a wellbore which allows the pump unit to be retrieved through the production tubing while leaving the tubing, electrical cable, and the remainder of the components of the pumping system in place. Basically, the pumping system is comprised of a production tubing string adapted to extend from the production zone to the surface. An electric motor is fixed to the bottom of the tubing and is connected to an electrical cable which, in turn, is payed out and attached to the outside of said production tubing as the tubing is lowered into the wellbore.

A pump unit, which is releasably positioned within the tubing, is releasably connected to said motor whereby the motor will drive the pump when electricity is supplied thereto through the cable. This allows the pump unit to be both retrievable and installable through the tubing without removing the production tubing string, the motor, or the electrical cable from the wellbore.

More specifically, the present invention provides a pumping system whereing a submersible pump unit, e.g. progressive cavity pump, centrifugal pump, etc., can be installed and retrieved through the production tubing without removing the tubing or the electrical cable normally associated therewith. Basically, the pump unit is comprised of a housing having an outside diameter smaller than the inside diameter of the tubing so that the pump unit can move up or down through the tubing. The pump unit has an driven gear on an input shaft which releasably mates with driving gear on an output shaft of a gear box of an electric motor which, in turn, is affixed on the lower end of the production tubing. This provides a good driving connection between the motor and the pump unit while allowing easy separation when the pump unit is to be retrieved.

A landing or seating nipple is connected into the tubing string and has a polished seat therein. The forward end of the housing of the pump unit has a polished surface which is adapted to seat onto the polished seat of the seating nipple to thereby form a seal between the tubing and the casing above the pump intake. The forward end of the housing when mated with the seating nipple provides the primary seal to hold the hydrostatic pressure of the fluid being pumped. A top seal having an expandable packer thereon is attached to the top of said housing to provide additional sealing between the pump unit and the tubing and to minimize solids accumulation between the outside diameter of the pump and the inside diameter of the tubing. The top seal includes means, e.g. "fishing neck", for attaching a wireline to said pump unit for retrieving said pump unit through said tubing.

Also, the present pumping system includes a means for releasably latching the pump unit within said production tubing when the pump unit is in an operable position adjacent the production zone. In one embodiment, a collar having slots therein is affixed within the landing nipple which cooperate with splines on the housing of the pump unit to prevent relative rotational movement therebetween. The slots include shoulders which engage the respective splines when power is applied to the pump unit to prevent upward movement of the pump unit in the tubing. Conversely, when the rotation of the pump is reversed, the splines move out from contact with the shoulders and the pump unit is released for retrieval. In a further embodiment, the housing of the pump unit has a saw-tooth configuration on its lower end which is received by a matching saw-tooth configuration on the landing nipple. Downward forces exerted during operation of the pump hold the two matching configurations together to prevent relative rotation between the pump unit and the tubing.

BRIEF DESCRIPTION OF THE DRAWINGS

The actual construction, operation, and apparent advantages of the present invention will be better understood by referring to the drawings which are not necessarily to scale and in which like numerals refers to like parts and in which.

BEST KNOWN MODE FOR CARRYING OUT THE INVENTION

Figure 1:
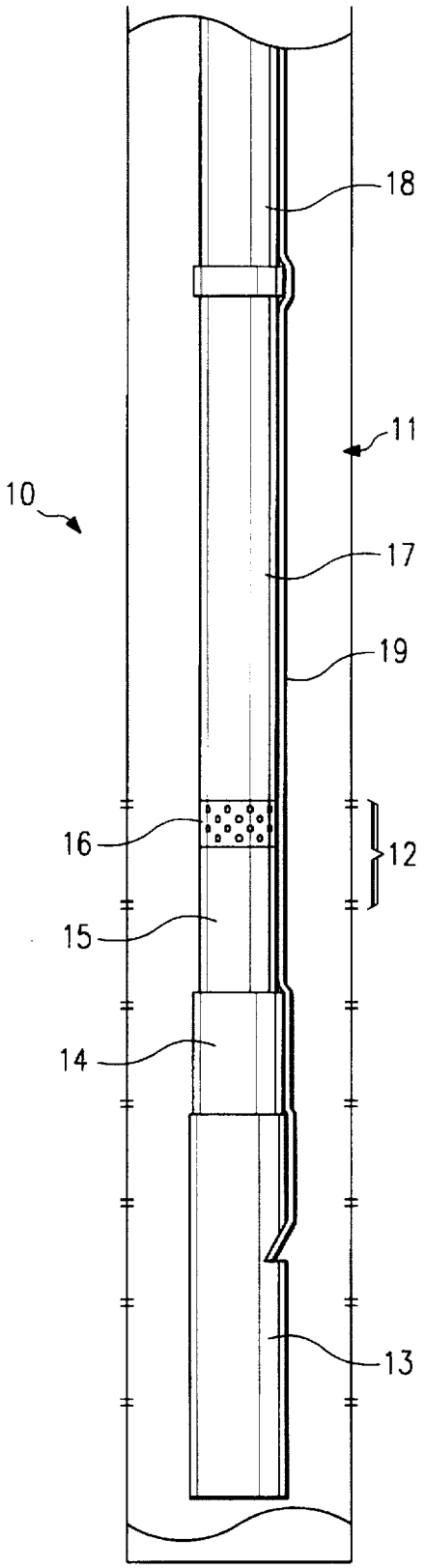
FIG. 1 (PRIOR ART)
FIG. 1 is an elevational view, partly in section, of a prior art downhole pumping system in place within a wellbore.

Referring more particularly to the drawings, FIG. 1 discloses a prior art, submersible, electrical-driven, downhole pumping system 10 in an operable position within a wellbore 11. While wellbore 11 is shown as being cased and having perforations 12 therein, it should be understood that the present invention can also be used in wells having "open-hole" completions. As shown, the prior art pumping system 10 is comprised of the following components: electric motor 13, transmission or gear box 14, protector section (seal) 15, perforated intake section 16, and pump unit 17.

All of the components of the pumping system 10 are threaded or otherwise assembled together onto the lower end of the production tubing string 18 through which the formation fluids are to be pumped to the surface. As the tubing string 18 is made-up and lowered into the well, electrical cable 19 is first connected to motor 13 and is then reeled out and clamped or otherwise secured to the outside of the tubing at spaced intervals, as will be understood by those skilled in the art.

Submersible pumping systems such as that described above are well known and are commercially-available. The pump unit 17 in such systems may be any type of downhole, electrically-driven submersible pump, e.g. a centrifugal pump or a progressive cavity pump, both of which are known and are commercially-available from different sources (e.g. Centrilift, Baker Hughes, Claremore, Okla.; Camco Reda Pump, Bartlesville, Okla.; et al). With such prior art pumps, the housing of the pump unit 17 is threaded or otherwise secured into pumping system which, in turn, is fixedly attached to and forms an integral part of the overall production string. Since the pump unit 17 is an integral part of the production string, the entire string of tubing 18, along with the cable 13, and all of the components of the pump system 10 must be removed and then reran into the wellbore each time the pump unit is retrieved.

This is unfortunate where the pump unit 17 wears at a much faster rate than will any of the other components of the pumping system (e.g. motor 13, gear box 14, protector seal section 15, or the intake 16). It is not unusual to have to service the pump unit 17 at relatively short intervals, for example, especially when producing dirty oil. As will be recognized by those skilled in this art, pulling and running of the tubing and the associated cable is expensive and time consuming and thereby adds substantially to the costs involved in operating submersible pump systems.

Figure 2:
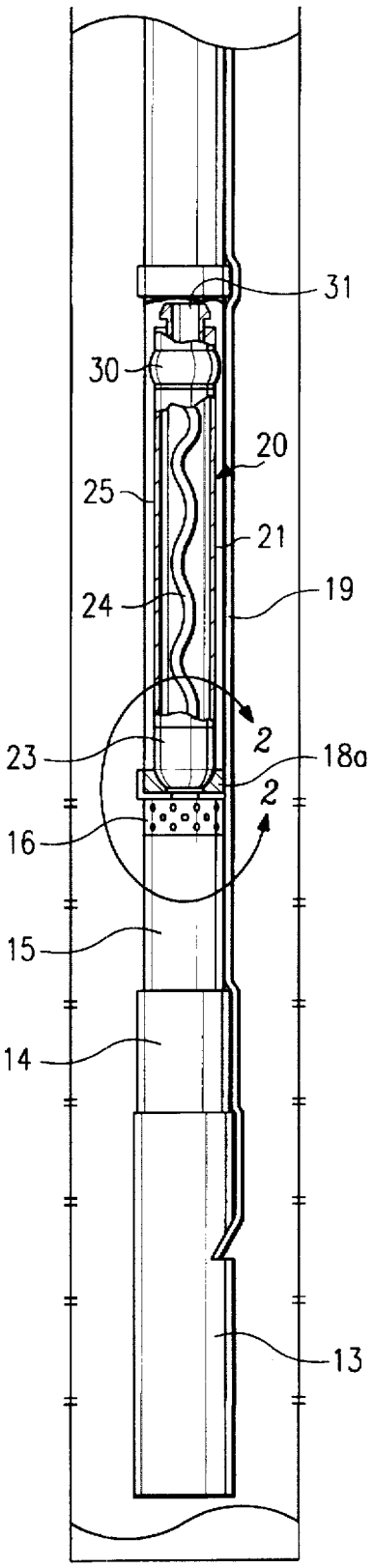
FIG. 2 is an elevation view, partly in section, of a downhole system in accordance with the present invention.

Referring now to FIG. 2, the pump system 20 of the present invention is in an operable position within wellbore 11. Pump system 20 is comprised of motor 13, gear box 14, protector seal section 15, and intake section 16, all of which are threaded together and assembled onto production tubing 18, similarly as described above. These components may be the same as those used in the conventional, submersible downhole pumping systems described above and are assembled in the same manner onto the lower end of string 18. Also, a seating nipple 18*a* is assembled into string 18, just above intake section 16, for a purposed described above.

Likewise, electrical cable 19 is connected to motor 13 and is clamped to the outside of tubing 18 as the tubing is made-up and lowered into the well. As will be understood, electric current for powering power rotary motor 13 is supplied through power cable 19 to thereby drive gear box 14 which, in turn, has an output shaft 22 which passes through the protector seal section 15 and terminates within intake section 16 (see FIG. 3). A drive or male gear 23 is fixed to the end of and is rotated by shaft 22 for a purpose described below.

In accordance with the present invention, pump unit 21 is not threaded or otherwise assembled onto the tubing string 18 as was the case with prior art systems, but instead, is retrievably positioned within the tubing as will be described below. Pump unit 21 is illustrated as being a progressive cavity (PC) pump which operates basically the same as conventional, commercially-available PC pumps (e.g. "ESPCP", available from Centrilift, a Baker Hughes Co., Claremore, Okla.). While pump unit 21 is illustrated as a PC pump, it should be recognized that unit 21 can also be other known types of submersible pumps, e.g. centrifugal pumps such as those available from Camco Reda Pumps, Bartlesville, Okla.

Pump unit 21 is comprised of a housing 25 which has an outside diameter smaller than the inner diameter of tubing 18 whereby unit 21 can easily pass through the tubing. As will be understood in the art, where pump unit 21 is a PC pump, a wobble joint or flexible shaft unit 25*a* is connected to and forms the lower end of housing 25 and is adapted to convert the concentric rotational motion from drive shaft 22 to the eccentric motion required to drive rotor 24 of the PC pump unit 21. An input shaft 26 extends from flex shaft unit 25*a* and has a driven female gear 27 thereon.

The outer surface 28 of the lower end of housing 25*a* conforms to the seating surface 29 on landing nipple 18*a*. Preferably, both of the mating surfaces are "polished" to thereby form a seal between the tubing and the casing when pump unit 21 is seated in nipple 18*a*. Additional sealing is provided between housing 25 and the interior of tubing 18 by packer means 30 which expands upon the seating of the housing 25 onto nipple 18*a*; e.g. "Oilmaster Automatic Top Seal", distributed by National Oilwell, Houston, Tex. The upper end of top seal 30 has a "fishing head" 31 thereon to which a conventional fishing tool (not shown) can be attached to retrieve pump unit 21 as will as will be understood by those skilled in the art.

Figure 3:
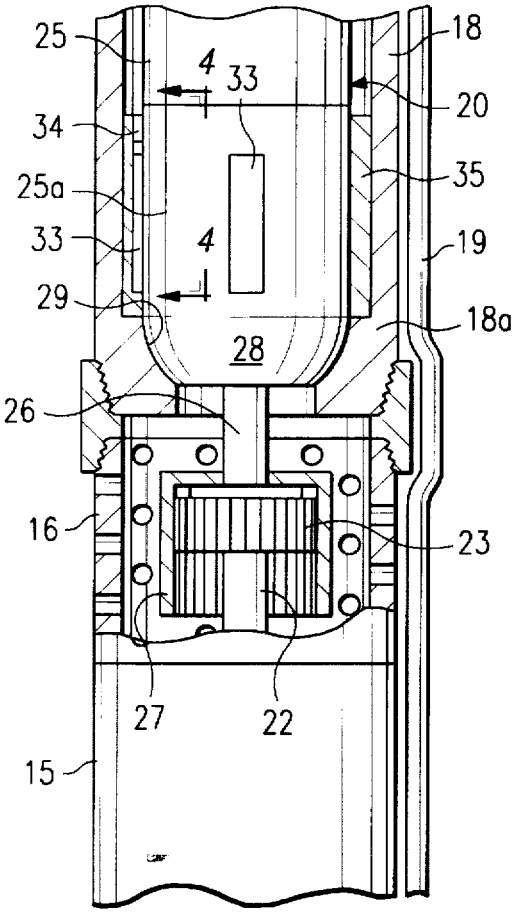
FIG. 3 is an enlarged sectional view taken within circular line 2—2.

As shown in FIG. 3, one or more elongated splines 33 are radially positioned around the lower end of housing 25*a*.

Figure 4:
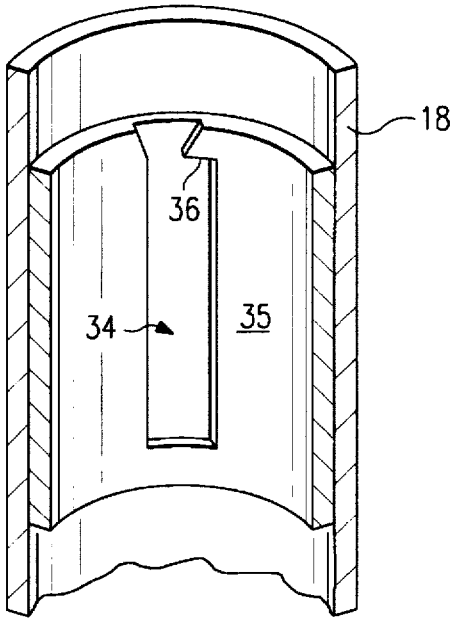
FIG. 4 is a perspective view, partly in section, of the production tubing of FIG. 3 taken between arrows 4 with the pump unit removed.

These splines cooperate with slots 34 in collar 35 which, in turn, is secured within tubing 18 just above the seating surface 29. Each slot 34 (only one shown in FIG. 4) is open at the top of the collar and its wide enough to easily receive a respective spline when housing 25 is lowered into seating nipple 18*a*. The top of the slots can be widely canted to funnel a spline into the slot. Each slot is widened along its length to provide a shoulder 36 therein for a purpose to be discussed below.

In operation, motor 13, gear box 14, protector section 15, intake section 16, and seating nipple 18*a* are threaded or otherwise coupled onto the lower end of tubing string 18. In initial installations, pump unit 17 can be positioned within tubing 18 so that polished surface 28 of housing 25 is landed on polished surface 29 of nipple 18*a*. Splines 33 will be received in their respective slots 34 and male gear 23 on drive shaft 22 will be received within female driven gear 27 on input shaft 26 to form a driving connection therebetween. It should be recognized that the male and female gears can be reversed on their respective shafts without affecting the driving connection between the motor and the pump.

String 18 is made up and lowered in wellbore 11 as electrical cable 19 is payed out and clamped thereto. Once the pumping system is in position, electric current supplied through cable 19 activates motor 19. As the motor rotates the rotor 24 in pump unit 21, the reactive forces will tend to rotate housing 25 the opposite direction thereby moving splines 33 under shoulders 36 within slots 34. It can be seen that splines 33 will prevent any further rotation of housing 25 within tubing 18 and further, the contact between the top of splines 33 and their respective shoulders 36 in slots 34 will prevent any upward movement of unit 21 thereby effecting latching pump unit 21 in place.

When pump unit 21 needs to be repaired or replaced, a conventional fishing tool (not shown) is lowered on a wireline in tubing 18 and is connected to fishing head 31. As the wireline is raised, packer 30 is retracted. The polarity of the current to motor 13 is reversed to rotate rotor 24 in an opposite direction. The reactive force on housing 25 moves splines 33 from under shoulders 36 to release pump unit so that the wireline can now raise pump unit 21 up tubing 18 to the surface leaving the tubing string 18, electrical cable, and the motor, etc. of pumping system 20 in the wellbore.

To replace pump unit 21, the new or repaired pump unit lowered through the tubing until the forward end of housing 25 contacts the seating surface in landing nipple 18*a*. Splines 33 will cam into slots 34 and gear 23 with be received into gear 27. When current is supplied to motor 13, housing 25 will rotate to again latch the pump unit in place. By being able to retrieve and replace only the pump unit 21 without pulling and re-running tubing 18, the present invention substantially reduces the costs normally incurred in the operation of submersible, downhole pumping systems.

Figure 5:
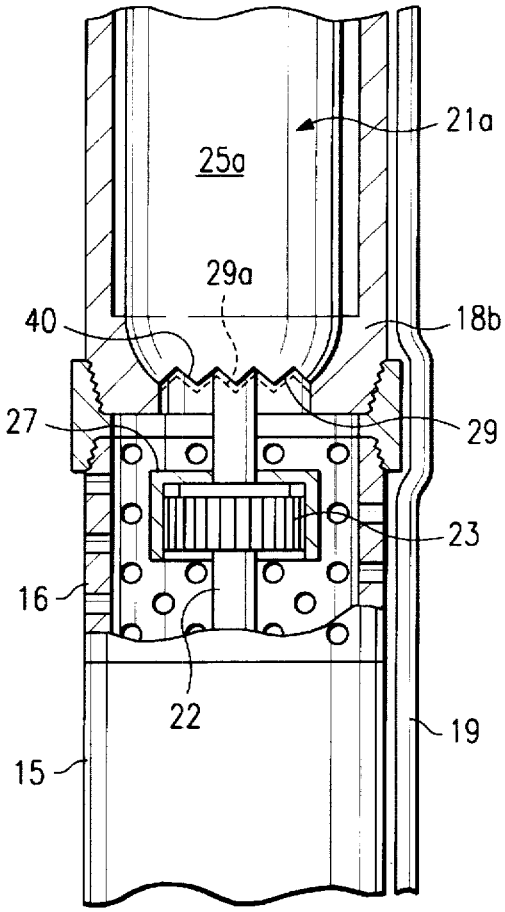
FIG. 5 is an enlarged sectional view, similar to FIG. 3 illustrating a further embodiment of the present invention.

FIG. 5 discloses a further embodiment of the present invention which is basically the same as described above but does not use the splines and slotted collar described above. Instead, the lower end of housing 25 is serrated to produce a saw-tooth configuration 40 which mates with a complimentary saw-tooth configuration (dotted lines 41) formed on landing nipple 29*a*. The rotational forces exerted on pump unit 21*a* during operation will continuously exert a downward force on the unit which will hold the pump unit in position on the landing nipple 18*b*. This downward force and the mating teeth on the unit 21*a* and nipple 18*b* will prevent rotation of housing 25*a* within tubing 18. It can be seen that by merely attaching a wireline to the upper end of the housing 25 and pulling upward, pump unit 21*a* will release and can be retrieved through the tubing.

What is claimed is:

1. A method for lifting fluids from a subterranean formation to the surface through a wellbore which penetrates said formation, said method comprising:

lowering a string of tubing down said wellbore to a point substantially adjacent said formation, said tubing having an electrical motor secured to the lower end thereof and a pump unit therein which is releasably connected to said motor; and retrieving said pump unit to the surface through said tubing when said pump unit needs servicing or replacing without removing said tubing.

2. The method of claim 1 including:

lowering a pump unit down through said tubing and reconnecting said pump unit to said motor.

3. A pumping system for lifting formation fluids from a production zone in a wellbore, said system comprising:

a production tubing string adapted to extend from said production zone to the surface;

an electric motor fixed to the bottom of said tubing;

an electrical cable connected to said motor and extending along the outside of said production tubing; and a pump unit releasably positioned within said tubing and releasably connected to said motor whereby said motor can drive said pump when connected, said pump unit being retrievable and installable through said tubing without removing said production tubing string, said motor, and said electrical cable from said wellbore.

4. The pumping unit of claim 3 wherein said pump unit comprises a progressive cavity pump.

5. The pumping unit of claim 3 wherein said pump unit comprises a centrifugal pump.

6. The pumping unit of claim 3 wherein said pump unit includes:

means for attaching a wireline to said pump unit for retrieving said pump unit through said tubing.

7. The pumping unit of claim 3 including:

a gear box connecting said motor to said pump unit.

8. The pumping unit of claim 3 wherein said pump unit includes:

means for forming a seal between the outer surface of said pump unit and the inner surface of said production tubing.

9. The pumping unit of claim 8 wherein said means for sealing comprises:

a landing nipple in said tubing string having a polished seat thereon; and wherein said pump unit has a polished surface adapted to seat onto said polished seat to thereby form a seal between said motor and said landing nipple.

10. The pumping unit of claim 9 wherein said pump unit comprises:

a housing having an outside diameter smaller than the inside diameter of said production tubing; and wherein said polished surface is at the front end of said housing.

11. The pumping unit of claim 10 including:

means to releasably latch said pump unit within said production tubing adjacent said production zone.

12. The pumping unit of claim 11 wherein said releasable latch means comprises:

a collar secured within said production tubing, said collar having at least one slot therein open at its top;

at least one spline mounted on said housing adapted to be received in said at least one slot in said collar.

13. The pumping unit of claim 8 wherein said pump unit comprises:

a housing having an outside diameter smaller than the inside diameter of said production tubing; and wherein said means for forming a seal comprises:

an expandable packer mounted on said housing.

* * * * *